US008069498B2

(12) United States Patent
Maddux et al.

(10) Patent No.: US 8,069,498 B2
(45) Date of Patent: Dec. 6, 2011

(54) PROTECTIVE ARRANGEMENT

(75) Inventors: Larry E. Maddux, Salem, IL (US); Raymond J. Drake, Jr., Salem, IL (US); Louis Anthony VanHoutin, Luka, IL (US); Vincent R. Long, St. Peters, MO (US); Cortney Warmouth, Edwardsville, IL (US)

(73) Assignee: Kranos IP Corporation, Litchfield, IL (US)

( * ) Notice: Subject to any disclaimer, the term of this patent is extended or adjusted under 35 U.S.C. 154(b) by 415 days.

(21) Appl. No.: 12/476,534

(22) Filed: Jun. 2, 2009

(65) Prior Publication Data

US 2010/0299812 A1 Dec. 2, 2010

(51) Int. Cl.
*A42B 3/06* (2006.01)

(52) U.S. Cl. ..... 2/414; 2/455

(58) Field of Classification Search ..... 002/414, 002/455

See application file for complete search history.

(56) References Cited

U.S. PATENT DOCUMENTS

| | | | | | |
|---|---|---|---|---|---|
| 2,809,908 | A | * | 10/1957 | French | 428/180 |
| 3,039,109 | A | * | 6/1962 | Simpson | 2/413 |
| 3,086,899 | A | * | 4/1963 | Ingraham et al. | 428/158 |
| 3,609,764 | A | * | 10/1971 | Morgan | 2/414 |
| 3,761,959 | A | * | 10/1973 | Dunning | 2/413 |
| 4,023,213 | A | | 5/1977 | Rovani | |
| 4,239,106 | A | * | 12/1980 | Aileo | 206/223 |
| 4,307,471 | A | * | 12/1981 | Lovell | 2/411 |
| 4,345,338 | A | * | 8/1982 | Frieder et al. | 2/414 |
| 4,432,099 | A | * | 2/1984 | Grick et al. | 2/412 |
| 4,472,472 | A | | 9/1984 | Schultz | |
| 4,535,553 | A | | 8/1985 | Derderian et al. | |
| 4,566,137 | A | * | 1/1986 | Gooding | 2/413 |
| 4,614,000 | A | * | 9/1986 | Mayer | 5/484 |
| 5,254,039 | A | * | 10/1993 | Garcia | 472/92 |
| 5,390,467 | A | | 2/1995 | Shuert | |
| 5,586,348 | A | * | 12/1996 | Toivio et al. | 5/710 |
| 5,894,045 | A | | 4/1999 | Desrondiers | |
| 5,953,761 | A | | 9/1999 | Jurga et al. | |
| 6,029,962 | A | | 2/2000 | Shorten et al. | |
| 6,128,786 | A | | 10/2000 | Maddux et al. | |
| 6,353,953 | B1 | | 3/2002 | Tanaka et al. | |
| 6,777,062 | B2 | | 8/2004 | Skaja | |
| 40,422 | A1 | * | 1/2010 | Morgan | 2/414 |
| 7,740,321 | B2 | * | 6/2010 | Brill et al. | 297/452.49 |
| 2006/0177635 | A1 | | 8/2006 | Pepe et al. | |
| 2009/0106882 | A1 | * | 4/2009 | Nimmons et al. | 2/414 |

* cited by examiner

*Primary Examiner* — Brian D Nash

(74) *Attorney, Agent, or Firm* — Notaro, Michalos & Zaccaria P.C.

(57) ABSTRACT

A protective arrangement has a rigid shell to cover a body part and at least one impact absorbing pad removably attached to the inner surface of the rigid shell. The pad has an outer part made of an outer curved sheet and an inner part made of an inner sheet that is parallel to and spaced inwardly from the outer sheet to define a space. The inner and outer sheets have a plurality of spaced apart projecting hollow protrusions extending to the other sheet, the protrusions of one sheet alternating with the protrusions of the other sheet to form an impact absorbing pattern of alternating protrusions in the space between the sheets.

15 Claims, 11 Drawing Sheets

PROTECTIVE ARRANGEMENT

FIELD AND BACKGROUND OF THE INVENTION

The present invention relates generally to the field of protective equipment and, in particular, to a new and useful arrangement of a hard shell with one or more shock absorbing inserts for use in a variety of athletic equipment such as football and other sports helmets, shoulder pads, shin and hip guards, as well as in other forms of protective equipment.

The use of protective equipment in both professional and recreational sports as well as in other activities has long been common. Additionally, protective helmets are often used by those who enjoy activities such as motorcycling and horseback riding. In fact, for some activities, the use of helmets and padding is required by law. Similarly, protective helmets and padding have been mandated for those who participate in professional sports. For example, for several decades the use of protective helmets and padding has been mandatory for athletes who play in the National Football League and the National Hockey League. More recently, protective padding and helmets have gained some acceptance and popularity in sports such as baseball and boxing.

In each case, these devices function to absorb the dangerous and abrupt transfer of energy experienced upon contact with, for example, the body of another player or participant, the projectile being used, the ground, or the first of a competitor. The prior art has sought to protect participants of these activities in several ways and over the years, protective athletic padding and helmets have undergone several improvements.

U.S. Pat. No. 6,029,962 to Shorten et al. discloses a shock absorbing component having a pair of surfaces with a plurality of inwardly extending indentations in the top and bottom surfaces. The indentations extend between the surfaces to provide support members for the shock absorbing component. At least some of the indentations are hemispherical. The surfaces may be formed of mesh material to allow the passage of gas or fluid therethrough. One or more inserts may be placed in the indentations. The shock absorbing component can be constructed by molding upper and lower shock absorbing component halves wherein the molds are configured to provide indentations in the top and bottom surfaces. The upper and lower halves are then joined to complete the shock absorbing component.

Additionally, U.S. Pat. No. 4,472,472 to Shultz discloses a protective device, such as a boxing helmet, rib or muscle protector, athletic mat, hockey helmet, motorcycle helmet and similar devices, that is formed such that the major shock absorption effect is accomplished by a series of bowed, preferably plastic, members which flex when the device is subjected to an impact, so as to absorb the shock and dissipate its transmission to the user. Because of-the nature of these bowed members, when the shock has been dissipated, the member returns to its original position so as to be able to absorb further shocks.

U.S. Pat. No. 4,535,553 to Derderian et al. discloses a shock absorbing sole member used in an athletic shoe having an upper and a sole. The shock absorbing sole member is comprised of an insert member and elastomeric foam encasing the insert member. The insert member is formed of resilient plastic material and includes a plurality of transversely and longitudinally spaced discrete shock absorbing projections. The elastomeric foam has a low hardness of less than 70 on the Asker C scale.

U.S. Pat. No. 5,894,045 to Desrondiers discloses a cellular core structure building element in the form of a three dimensional arrangement of pyramidal elements in a continuous rectangular pattern interconnected at their bases by a base plane panel. The pyramid elements are normally void internally to form a structurally strong. lightweight panel. The common pyramid structure is modified by truncating the top of the pyramid to form a top face and by flattening the side face edges to form edge faces thereby creating a pyramid with a top face, four side faces and four edge faces. For best strength as a construction or building material, two cellular core structure sheets are superimposed one on the other by inverting and offsetting one relative to the other such that when mated the pyramid elements of one sheet fit between the pyramid elements of the other so that mating faces may be attached. Continuous face sheets may be added to the external faces of the structure.

U.S. Pat. No. 6,777,062 to Skaja discloses a flexible shock absorbing component providing cushioning for surfaces, especially wall and floor surfaces. The shock absorbing component includes two sheets of thermoplastic, each sheet with inwardly facing, opposing, resiliently compressible indentations extending into a cavity between the two sheets. The shock absorbing component also includes a layer of particulate matter applied to and adhered to the outer surface of one of the sheets, to provide wear and weather resistance. A moderator may also be attached to the outer surface of the sheet.

U.S. Patent Application 2006/0177635 to Pepe et al., discloses a two-layer structural material of sandwich design which comprises opposed, generally planar sheets having interlocking protrusions. The material may be formed of plastic resin, metal, paper, paperboard, or composite material and has increased rigidity over single sheet material without the complexity of 3-layer materials such as corrugated board and honeycomb-cored structures.

These known designs, however, suffer from an interference between adjacent projections that is here called parallelograming. That is, when the projections are compressed to a ceratin point, because the projections are either touching or are very close to each other, the shock absorbing effect is compromised. When two neighboring projections start to compress as a result of an impact, their side walls move outwardly and come into contact with each other. As the pad is compacted, the walls of the adjacent projections end up in a position where they act as a perpendicular support member between the two opposing sheets at which point the padding will have virtually no give and will thereafter transfer the force of the impact directly to the wearer.

Additionally, good ventilation is an important characteristic for any padding member, but is lacking an many prior art pads.

Furthermore, the prior art has sought to protect players and participants of various sports and activities through the advent of various helmets and helmet configurations.

For example, U.S. Pat. No. 5,953,761 to Jurga et al. discloses protective headgear which is defined by a forward substantially concave rigid shell and a rear substantially concave rigid shell which are interconnected. This patent uses resilient straps which snap together portions of the forward shell to edge portions of the rear shell. A rigid framework which has a relatively large view opening is also employed;

U.S. Pat. No. 6,128,786 to Maddux et al. discloses a helmet which includes a shell having a front surface, a rear surface, a first side surface and a second side surface, wherein the front, rear, first side and second side surfaces define an interior space. The Maddux et al. patent further includes straps with first and second ends attached to the shell, wherein the straps form a receptor within the interior space.

A further example is seen in U.S. Pat. No. 4,023,213 to Rovani which discloses a shock-absorbing system for use in protective helmets such as football helmets or crash helmets. Rovani includes an impact-resistant shell, a plurality of webs secured to the inside of the shell in the crown portion, and a plurality of flexible plastic compartments containing foam secured to the webs, the compartments being interconnected by means of orifices of relatively small size and the interior of the compartments being at atmospheric pressure or slightly above.

Irrespective of shell shape and other helmet features and arrangements, the helmets and headgear in the prior art use forms of padding which are currently known, examples of which were discussed above. Those who wear helmets of the prior art that use plural projections are still exposed to the added risk of injury due to the problem of parallelograming decreasing the shock absorbing effect.

There is therefore a need for an improved protective arrangement of the type disclosed and claimed below.

SUMMARY OF THE INVENTION

It is an object of the present invention to provide a protective arrangement, which may advantageously be a helmet, but which can alternatively be part of any other protective guard that has a shell with an inner concave surface, and one or more specially structured pads attached to the inner surface of the shell.

The helmet of the invention has a protective arrangement that comprises a rigid helmet shell adapted to cover the head of a wearer, the rigid shell having an inner surface with selected concave curvatures, the inner surface having a frontal portion, a crown portion, a pair of opposite temporal portions, and an occipital portion and a plurality of impact absorbing pads spaced apart on, and removably attached to the inner surface of said rigid shell. The pads comprise a frontal pad removably attached over the frontal portion, a crown pad removably attached over the crown portion; a pair of temporal pads removably attached over the respective temporal portions, and an occipital pad removably attached over the occipital portion, each pad being made of at least two parts of molded thermoplastic urethane that are welded together.

The pads each also comprise at least one outer part comprising an outer sheet having the selected curvature of the rigid shell adjacent the portion of the inner surface to which the pad is removably attached, and at least one inner part comprising an inner sheet that is substantially parallel to and spaced inwardly from the outer sheet to define a space between the inner and outer sheets that is entirely open around a whole perimeter of the inner and outer sheets. Each of the inner and outer sheets have a plurality of spaced apart projecting hollow protrusions extending to the other sheet, the protrusions of one sheet alternating with the protrusions of the other sheet to form an impact absorbing pattern of alternating protrusions in the space between the sheets.

Each protrusion has a open larger diameter base at the sheet from which it extends, a smaller diameter circular flat peak, usually but not always with a peak opening therein, and a side wall that tapers from the base to the peak, each base being one piece with the sheet from which it extends and each peak being fused to the sheet of the other part of the pad, the peak opening in each peak extending also through the sheet of the other part of the pad for additional ventilation.

At least some of the sheets have additional vent openings between the open base of their protrusions and peak openings and including at least one scalloped edge at the open periphery of the space to save material and weight and provide even more ventilation.

The more general case of the invention for use to protect any body part of the wearer comprises a rigid shell adapted to cover the body part of a wearer, the rigid shell having an inner surface with at least one selected concave curvature and at least one impact absorbing pad removably attached to the inner surface of the rigid shell, the pad comprising at least one outer part comprising an outer sheet having the selected curvature of the rigid shell and at least one inner part comprising an inner sheet that is substantially parallel to and spaced inwardly from the outer sheet to define a space between the inner and outer sheets that is open around a perimeter of the inner and outer sheets.

Each of the inner and outer sheets has a plurality of spaced apart projecting hollow protrusions extend to the other sheet, the protrusions of one sheet alternating with the protrusions of the other sheet, generally in parallel pairs, to form an impact absorbing pattern of alternating protrusions in the space between the sheets, each protrusion having an open larger diameter circular base at the sheet from which it extends, a smaller diameter circular flat peak, usually but not always with a peak opening therein, and a frustoconical side wall that tapers from the base to the peak. Each base is made, preferably by extrusion, as one piece with the sheet from which it extends and each peak is fused to the sheet of the other part of the pad, the peak opening in each peak extending also through the sheet of the other part of the pad.

At least some of the sheets have additional vent openings between the open base of their protrusions and peak openings and including at least one scalloped edge at the periphery of the space in the more general case of the invention as well.

The various features of novelty which characterize the invention are pointed out with particularity in the claims annexed to and forming a part of this disclosure. For a better understanding of the invention, its operating advantages and specific objects attained by its uses, reference is made to the accompanying drawings and descriptive matter in which a preferred embodiment of the invention is illustrated.

DESCRIPTION OF THE PREFERRED EMBODIMENTS

Figure 1:
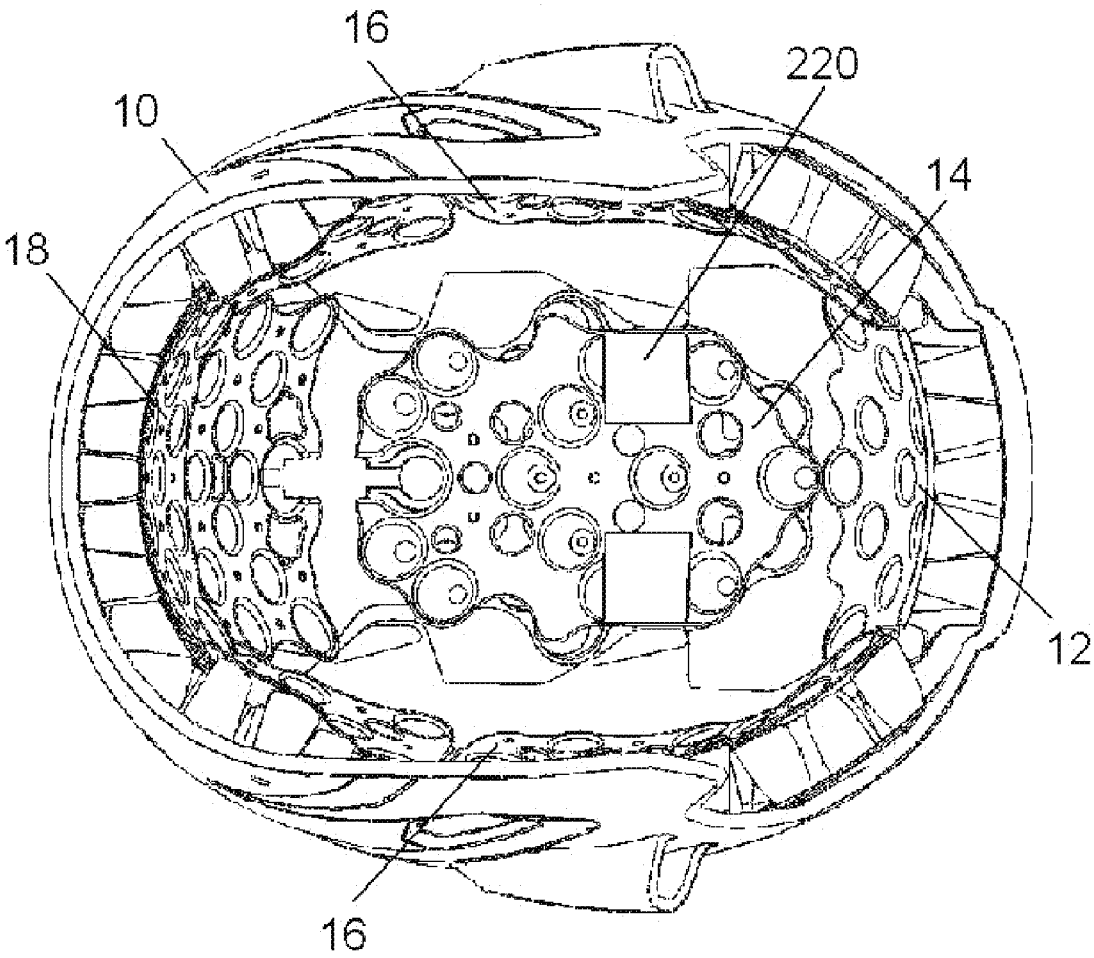
FIG. 1 is a bottom or inside plan view of a football helmet with a set of pads that form one embodiment of the protective arrangement of the present invention.

Referring now to the drawings, in which like reference numerals are used to refer to the same or similar elements, FIG. 1 shows a protective helmet arrangement of the present invention with a rigid helmet shell 10 adapted to cover the head of a wearer, the rigid shell being made of rigid plastics of types that is known to those skilled in the art such as a polycarbonate, a rigid thermoplastic, or a thermosetting resin. The shell 10 has an inner surface with selected concave curvatures, the inner surface having a frontal portion, a crown portion, a pair of opposite temporal portions, and an occipital portion. The invention provides a plurality of impact absorbing pads spaced apart on, and removably attached to the inner surface of the rigid shell.

Figure 2:
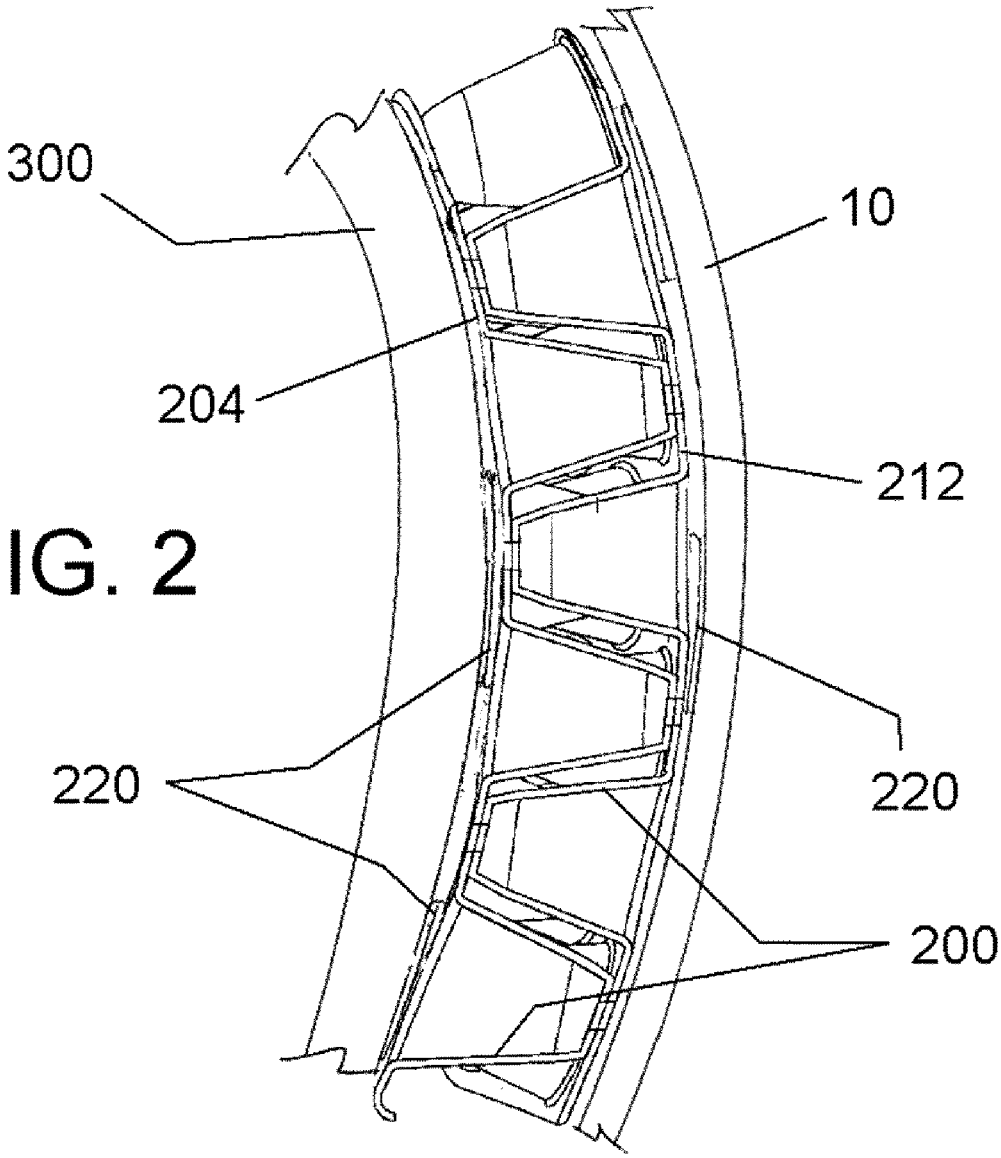
FIG. 2 is a fragmentary sectional view of a protective arrangement with pad, shell and internal padding for use as part of a shin, shoulder, hip, thigh, head or other protective arrangement of the present invention.
Figure 3:
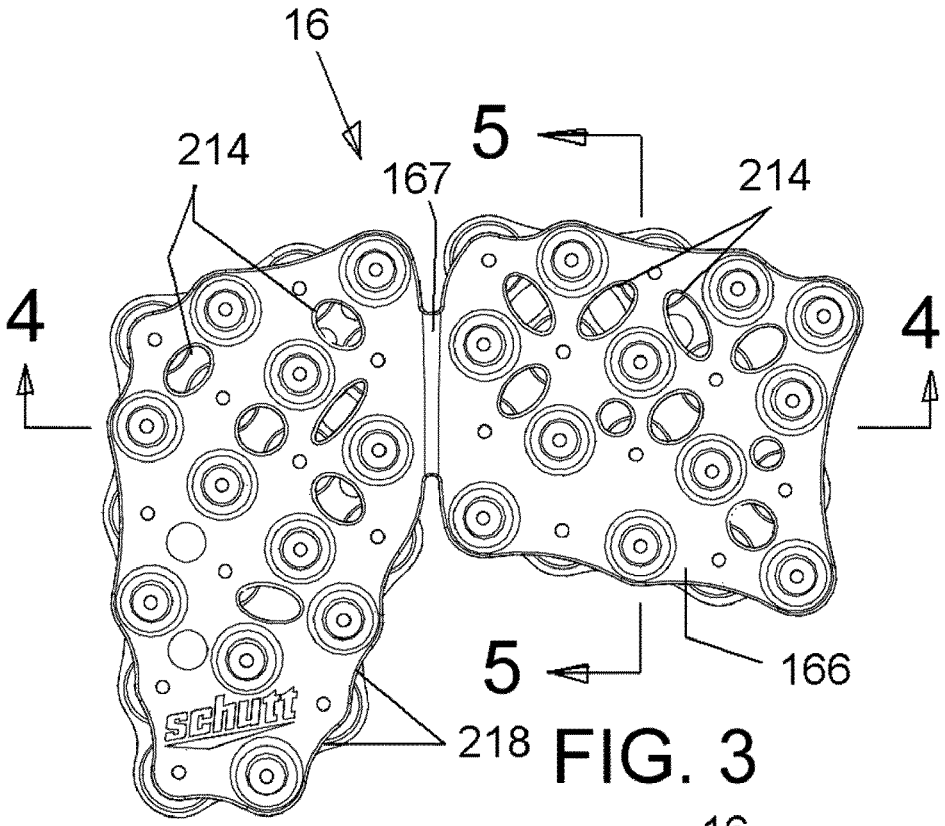
FIG. 3 is an inside plan view of a left temporal pad of the invention of FIG. 1, showing the inside concave surface of the pad that is designed to match the outside curvature of additional temporal padding that is meant to engage the side of the head of a player wearing the helmet.

Although in FIGS. 1 and 3 to 10, the embodiment of a helmet, in particular, a football helmet is shown, the present invention can be used for other protective arrangements as shown generally in FIG. 2, that include a shell 10 with a selected inner concave curvature, an inner additional padding 300 for engagement against the wearer's body part to be protected, and one or more pads therebetween, for example, as parts of a shin guard, hip guard, thigh guard, shoulder pad, or other types of sports helmets such as a baseball batting helmet, a lacrosse helmet, a hockey helmet, a bicycle or motor cycle helmet, a racing car helmet, a construction workers helmet, or other crash helmet or headgear where protection of the head is desired, or other protective equipment for protecting a body part from impact by providing a layer of impact protective pads.

The principles of the structure and function of the pads as will be explained in greater detail below, can be adapted to these different impact absorbing guards and helmet by those having ordinary skill in this art.

Returning to the non-limiting example of the football helmet of FIG. 1, the plurality of pads in the helmet shell 10 include, a frontal pad 12, removably attached, for example by adhesively applied hook and loop tapes 220 (see FIGS. 5, 6 and 10 as well), over the frontal portion, a crown pad 14 removably attached over the crown portion, a pair of temporal pads 16, removably attached over the respective temporal portions, and an occipital pad 18, removably attached over the occipital portion. The removable attachment is preferred in sports helmets since the pads and other linings (e.g. inner foam padding at 300 in FIG. 10 between the wearer's head and the inner surface of the pads) are periodically replaced to recondition the helmet to make sure that the impact absorbing properties of the helmet are maintained over time. In addition to, or instead of hook and loop tapes, snaps and/or screws may also be used in particular in areas of the helmet where other structures such as face guards and chin straps (not shown) are to be mounted.

Figure 7:
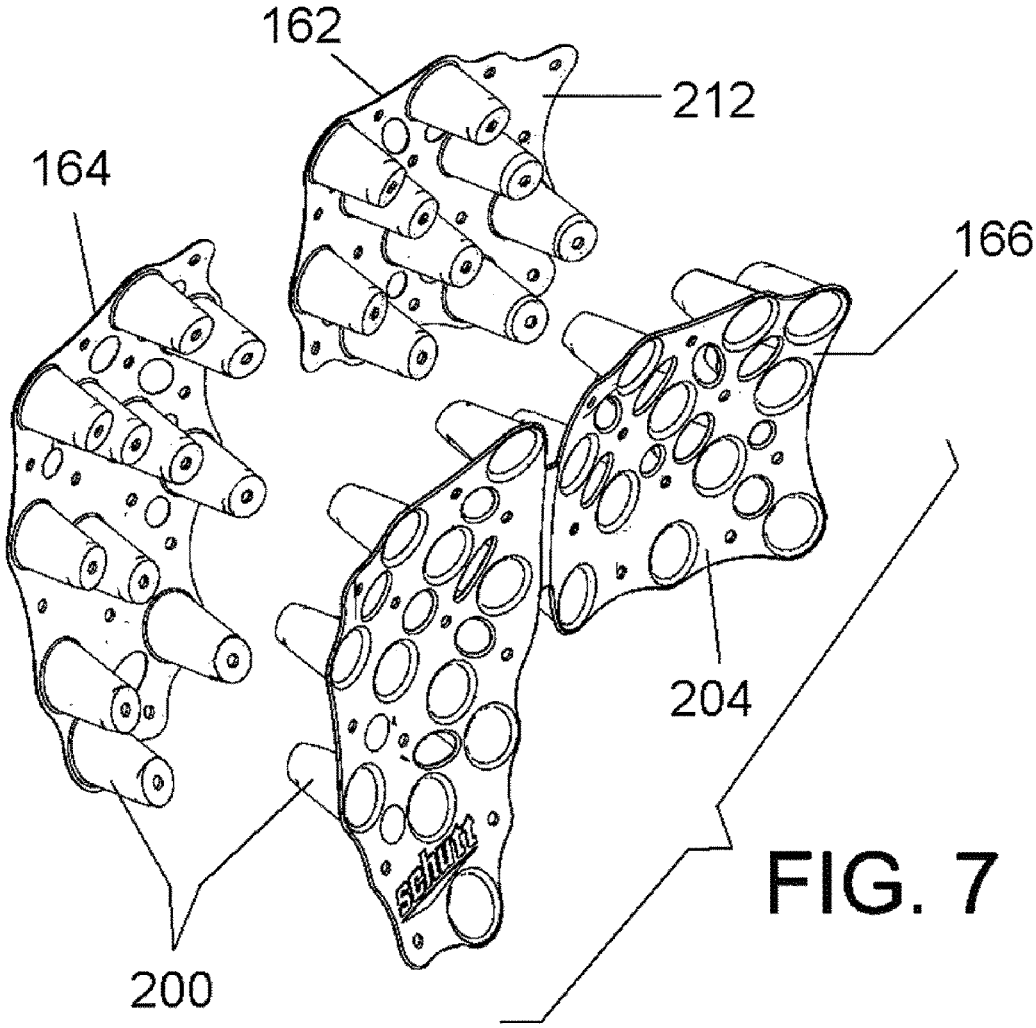
FIG. 7 is an exploded, rear, top, inside perspective view of the pad of FIG. 3 showing the three injection molded, thermoplastic urethane elastomer (TPU) parts that are welded together at the peaks of the projections of each part, to form the pad.

Each pad is preferably made of at least two parts of molded thermoplastic urethane, for example as illustrated in the exploded view of FIG. 7 of the left temporal pad 16, that are welded together as will be explained below.

Figure 4:
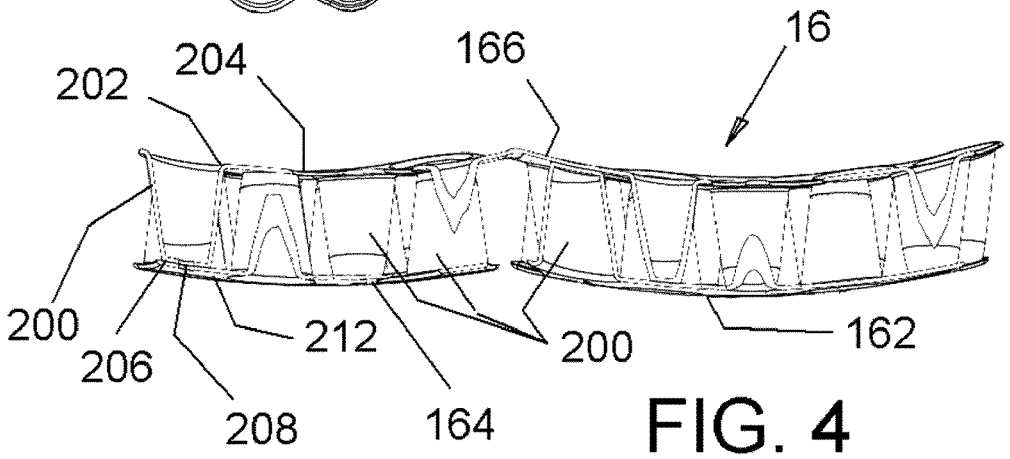
FIG. 4 is a front to back and downwardly facing longitudinal sectional view taken along line 4-4 of FIG. 3.
Figure 5:
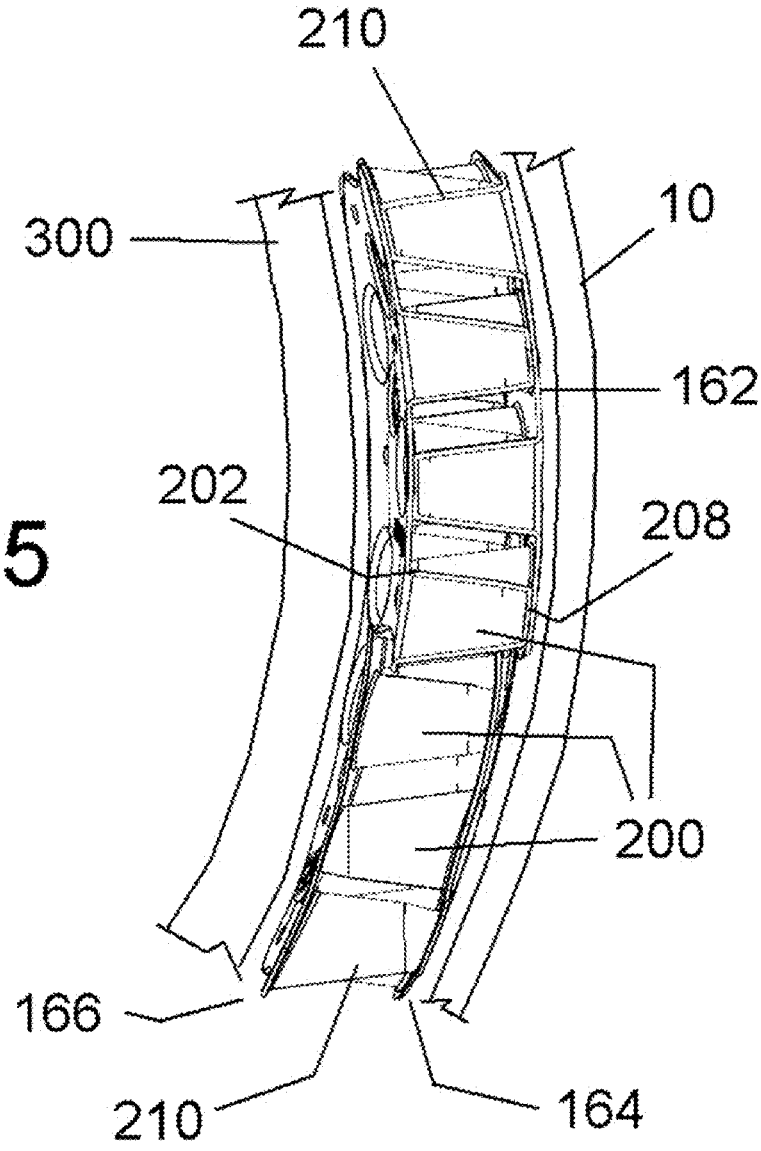
FIG. 5 is a bottom to top and rearwardly facing longitudinal sectional view taken along line 5-5 of FIG. 3 which also shows some of the outer shell and inner further padding of the invention.
Figure 6:
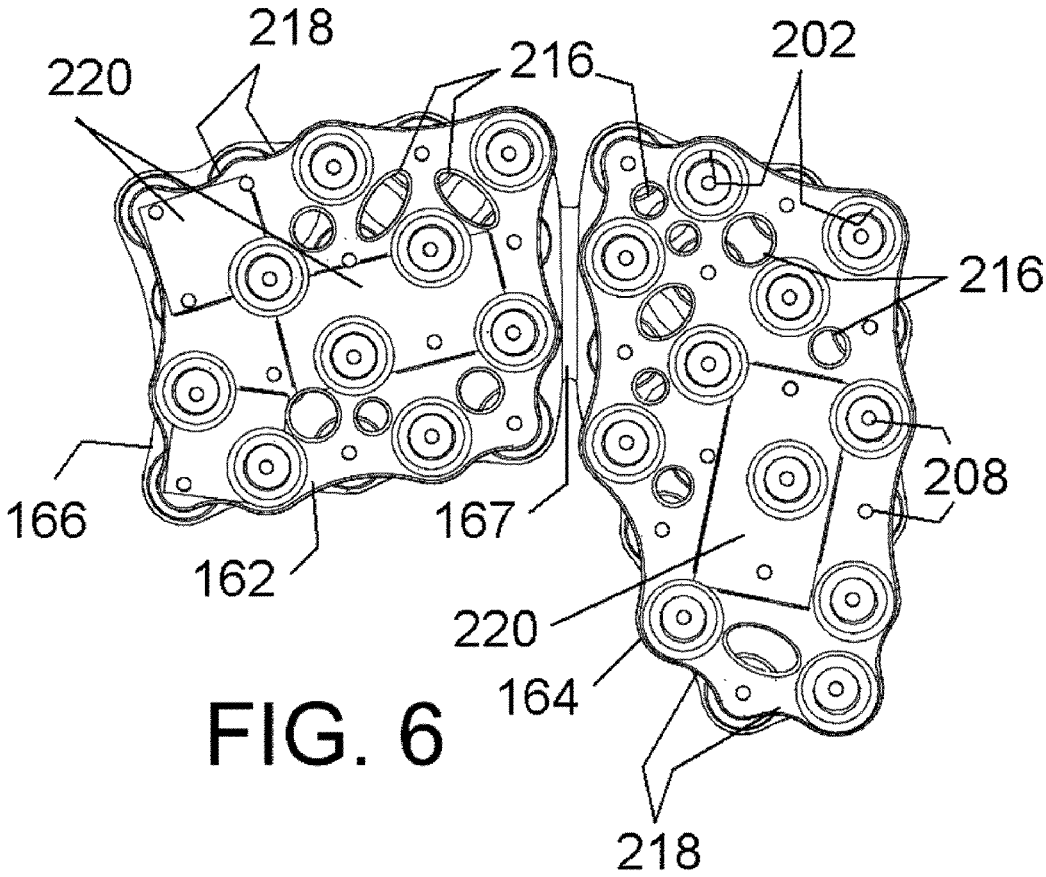
FIG. 6 is an outside plan view of the pad of FIG. 3, showing the outside convex surface of the pad that is designed to match the inside curvature of the helmet shell.

As shown for example in FIGS. 3-7, the pads, in this case the two part temporal pad 16, each comprising at least one, but in the case of the temporal pads, two outer parts 162 and 164, comprising an outer sheet having the selected curvature of the rigid helmet shell 10 adjacent that portion of the inner surface to which the pad is removably attached, that is the temporal inner surface of the helmet. The pad also includes at least one inner part 166 comprising an inner sheet that is substantially parallel to and spaced inwardly from the outer sheet 162, 164, to define a space between the inner and outer sheets that is open around the perimeter of the inner and outer sheets as best shown in FIGS. 4 and 5. Each of the inner and outer sheets also, and importantly, have a plurality of spaced apart, projecting hollow protrusions 200 extending to the other sheet, the protrusions of one sheet alternating with the protrusions of the other sheet to form an impact absorbing pattern of alternating protrusions 200 in the space between the sheets.

Figure 8:
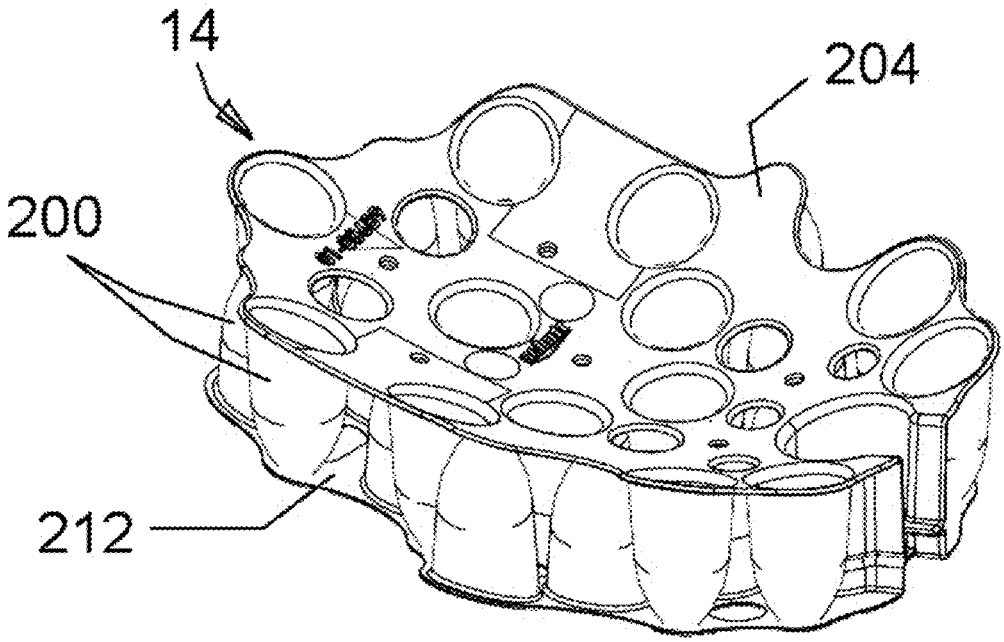
FIG. 8 is a rear, right, inside perspective view of a crown pad of the invention, showing the inside concave surface of the pad that is designed to match the outside curvature of additional crown padding (not shown) that is meant to engage the top of the head of a player wearing the helmet.
Figure 9:
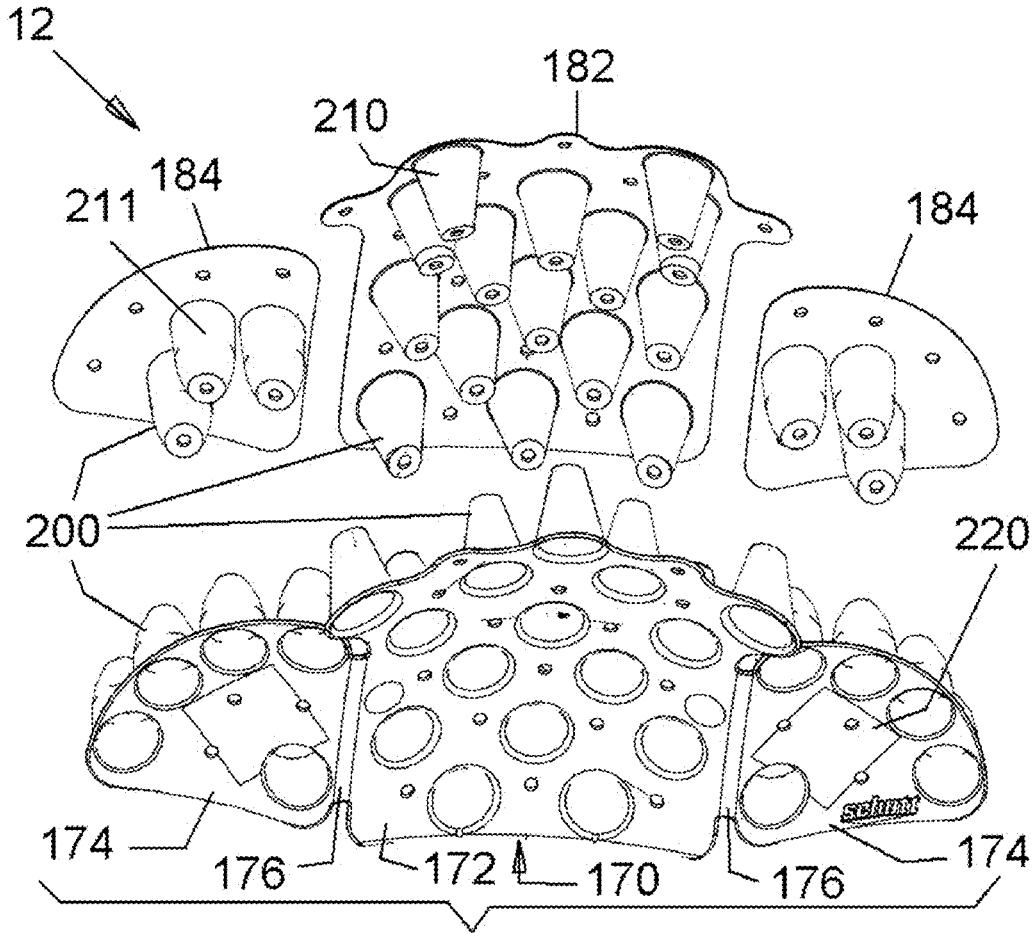
FIG. 9 is an exploded, inside, top perspective view of a frontal pad of the invention, showing the inside concave surface of the pad that is designed to match the outside curvature of additional frontal padding (not shown) that is meant to engage the forehead of a player wearing the helmet and showing the four injection molded TPU parts that are welded together at the peaks of the projections to form the frontal pad.
Figure 10:
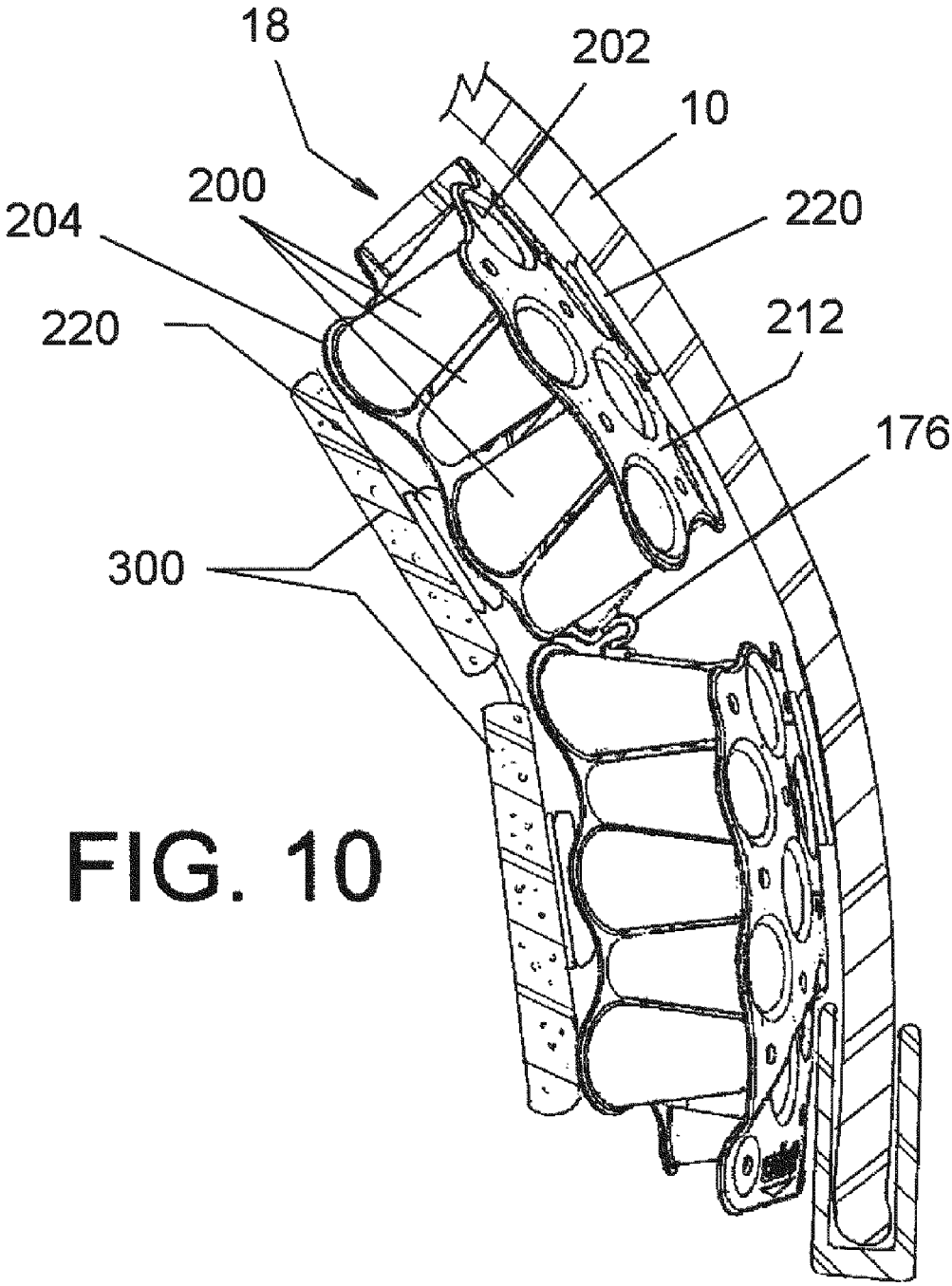
FIG. 10 is a left side elevational view of an occipital pad of the invention, showing how the two parts for the pad that are separated by a live hinge of the same TPU material as the rest of the pad, is folded inwardly so that the outer convex surface of the two parts are made to follow the same concave inside surface of the rear of the helmet shell, the inside concave surface of the occipital pad being curved to match the outside curvature of additional rear head padding that is meant to engage the back of the head of a player wearing the helmet.

In areas of likely high impact and therefore, need for greater impact absorption, the alternating protrusions 200 are more densely packed and therefore spaced more closely to each other, for example, in the central part of the frontal pad 12 and in the back or occipital pad 18 as shown in FIGS. 9 and 10. The protrusions 200 are less densely packed and therefore spaced further from each other in the side or temporal pads 16 and the top or crown pad 14 as shown in FIGS. 7 and 8.

Each protrusion 200, as shown for a representative protrusion at the left in FIG. 4, has an open, preferably circular larger diameter base 202 at the sheet 204 from which it extends, a smaller diameter, preferably flat circular peak 206 with an even smaller peak opening 208 therein, and a preferably curved or straight frustoconical side wall 210 that tapers from the open base 202 to the closed peak 206. Each base 202 is molded as one piece with the sheet 204 from which it extends and each peak 206 is heat fused to the sheet 212 of the other part of the pad, in this case the sheet 212 or outer pad part 164. The peak openings 208 in selected peaks extend also through the sheet of the other part of the pad so that a continuous air passage is formed across each pad for added ventilation.

At least some of the sheets, e.g. the inner and outer sheets 204 and 212 of the temporal pads 16, having additional vent openings 214 and 216 respectively, between the open bases 202 of their protrusions 200 and peak openings 208, for increased ventilation and also to reduce the material used in each pad, and thus the weight of each pad. To further reduce weight, most pads also have at least one scalloped edge 218 at the open periphery of the space around each pad. The term scalloped is used here to mean an edge of the inner sheet 204 and/or outer sheet 212 that smoothly follows the outer contour of each protrusion base 202 or peak 206 near that edge, and which smoothly turns inwardly to form a concave indentation in the edge between the base or peak as best shown for all the outer edges of the sheets for the temporal pads 16 in FIGS. 3 and 6, and for some of the edges of the sheets of the crown pad 14 (FIG. 8), the frontal pad 12 (FIG. 9) and the occipital pad 18 (FIG. 10).

The material of all the pad parts, including the curved sheets 204 and 212, and the extending alternating protrusions 200, are of polymer, for example, Estane ETE 50DT3 by Lubrizol Advanced Materials, Inc. This is a TPU-Polyether or Thermoplastic Urethane Elastomer (Polyether). Protrusions 200 of the same material are conical in shape with a flat end and protrude or extend out of the plane of its sheet 204 or 212. When under load of impact, the protrusions 200 compress, minimizing acceleration of the wearer's head in the helmet, and thus reducing the impact.

For all embodiments of the invention, there are no inserts or rubber members or parts present inside any of the protrusions 200 nor in the space between the sheets 204 and 212. The sheets are also curved in shape to conform to the shell that is used in conjunction with the component, e.g. to the human head for a helmet, or other body part that is to be protected. The parts all have protrusions where the side walls 210 of adjacent protrusions 200 are not in contact or connected to each other to make them more flexible. The protrusions from both sides have opposing angles to stabilize the parts, keeping them from parallelogramming (i.e. interfering with each other) during compression.

Examples of other plastics that may be employed in the practice of the present invention include: ABS (acrlyonitrilebutadiene-styrene); Polyethylene; Polypropylene; Polystyrene; Polyesters; Polycarbonate; PVC (polyvinyl chloride); Nylon; and PMMA (polymethyl methacrylate). Foamed plastic materials may also be advantageously used. The preferred material employed for all parts of the pads, however, is Thermoplastic Urethane (TPU), and/or a Thermoplastic Elastomer (TPE) as the material for forming the cushioning system.

As shown in the drawing figures, the protrusions may be truncated so as to provide a generally flat "plateau" in place of a semicircular apex. The opposing plateaus provide a better contact area and bonding area between the protrusions and the respective other sheet in each pad.

The structure of the present invention can have uniform rigidity if the protrusions are laid out in a uniform pattern and can have varying rigidity, tuned for a specific application, by varying the size, spacing and the geometry of the protrusions. The rigidity of the material may also be adjusted by varying the type and degree of bonding between the interlocked protrusions, in general, stronger adhesives and greater density of bonding sites provides a stiffer material.

There are areas of the helmet shell that will require stiffer (firmer) cushioning, as well as areas of the shell where a softer (more pliable) cushioning will perform better. For instance, in the front of the helmet just above the wearer's eyes, the shell is at it's weakest area as to flexing, because this is an area where a section of the shell has been cut out of the basic spherical shape of the shell, and leaves the brow area weaker (easier to flex) than other areas that are still within the basic sphere (rear, crown and sides). The helmet therefore needs a stiffer cushioning material backing up the brow area, whereas the sides (temporal) and crown areas may need to be of a softer cushioning structure, and the rear needs a compression resistance somewhere in between.

Internally within the rigid shell 10 and pads 12, 14, 16 and 18, a further shock absorbing padding insert of softer, covered foam material is provided, shown for example at 300 in FIG. 10, removably attached to the inside surface of the pad assembly by hook and loop tapes 220 or other means.

FIG. 9 illustrates the multi part frontal pad 12 with one inner part 170 having a central portion 172 that is connected by two live hinges 176 to opposite side portions 174, on either side of the central portion 172. Three outer parts 184, 182, 184 are also provides which are likewise molded and fused or welded to the inner part 170. The live hinges 176 that are molded as one piece with the portion 174, 172, 172, allow the four parts 170, 182, 184 and 184, to be molded and assembled while they are virtually flat, but then to be bend at the live hinges 176, to conform to the inner concave curvature of the helmet shell.

FIG. 9 also illustrates how the alternating protrusions 200 in the center portion 172 have straight conical walls 210 for higher impact resistence (i.e. are harder and thus harder to squash) then the curved side walls 211 of the alternating protrusions 200 in the side portions 174 which are more easily squashed and thus provide less impact resistance and are softer. Softer curved side walls in the protrusions 200 are also used in the crown pad 14 of FIG. 8. As shown in some of the embodiments the straight side walls 210 may be continuous with no change in slope from the base to the peak, of bend once slightly inwardly before reaching the flat peak as in FIG. 5, for example. Since the level of potential impact is the same at all positions of the helmet (i.e. any portion of the helmet can be hit with the same force as any other portion), the material absorbing the impact needs to be firmer or softer depending on the location of the impact around the wearer's head. According to the invention, thus, the helmet can be fine-tuned by placing protrusions of higher or lower impact resistance at selected locations around the inside of the helmet. The spacing or density of packing of the protrusions can also be used to fine-tune this impact absorbing resistance around the inside of the helmet.

FIG. 10 illustrates the action of the live hinge 176 between the upper and lower portions of the inner part of the occipital pad 18, that allows it to be bend to the contour of the inner shell surface.

The frontal and crown, temporal and occipital pads are made from material having a hardness of between about 60 Shore-A and 90 Shore-D so that impact resistance of the pads can be tuned more closely to the impact needs at selected areas in the helmet.

Figure 11:
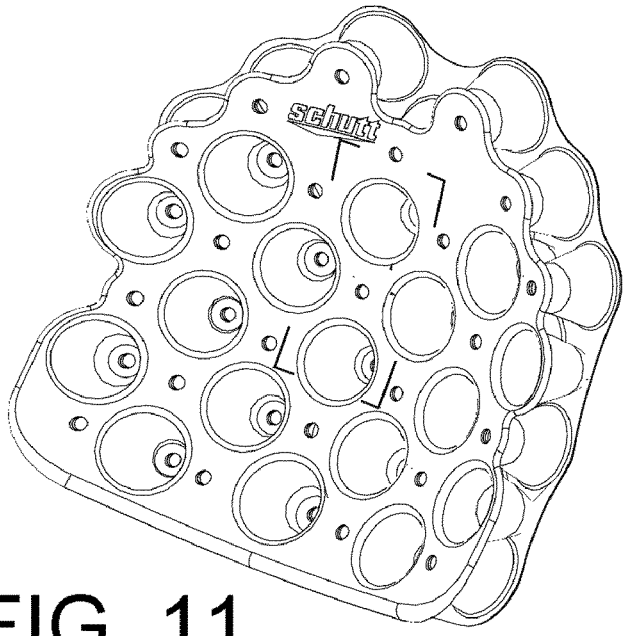
FIG. 11 is an inside perspective view of a different embodiment of a frontal pad of the present invention.
Figure 12:
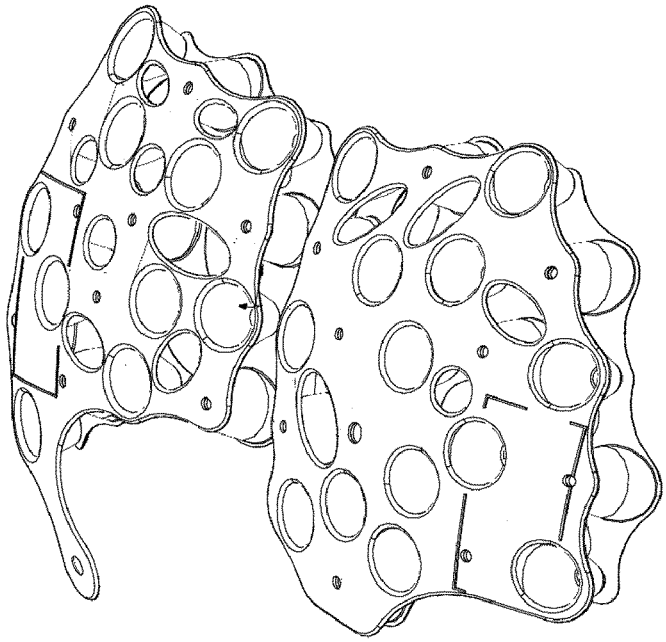
FIG. 12 is an outside perspective view of a different embodiment of a right temporal pad of the present invention.
Figure 13:
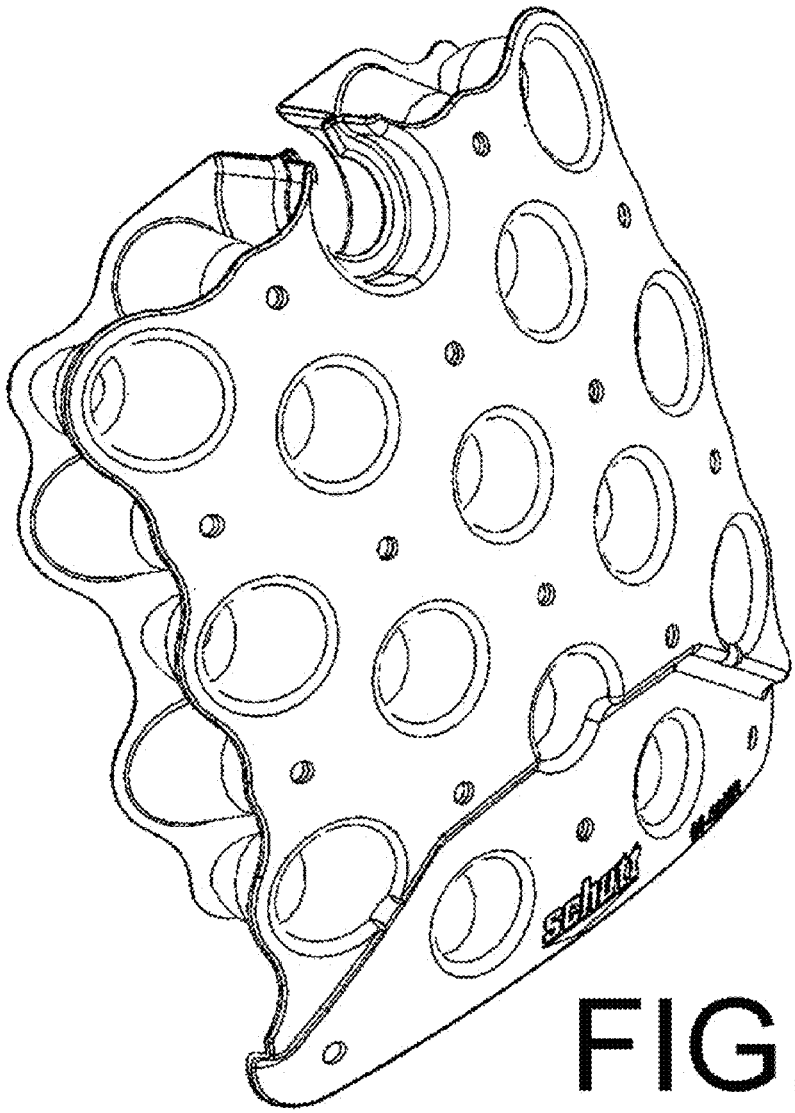
FIG. 13 is an inside perspective view of a different embodiment of an occipital pad of the present invention.

FIG. 11 shows a different embodiment of a frontal pad of the present invention while FIG. 12 shows a different embodiment of a right temporal pad of the present invention and FIG. 13 shows a different embodiment of an occipital pad of the present invention.

While specific embodiments of the invention have been shown and described in detail to illustrate the application of the principles of the invention, it will be understood that the invention may be embodied otherwise without departing from such principles.

What is claimed is:

1. A protective helmet arrangement comprising:

a rigid helmet shell adapted to cover the head of a wearer, the rigid shell having an inner surface with selected concave curvatures, the inner surface having a frontal portion, a crown portion, a pair of opposite temporal portions, and an occipital portion;

a plurality of impact absorbing pads spaced apart on, and removably attached to the inner surface of said rigid shell, said plurality of pads comprising: a frontal pad removably attached over the frontal portion; a crown pad removably attached over the crown portion; a pair of temporal pads removably attached over the respective temporal portions; and an occipital pad removably attached over the occipital portion; each pad being made of at least two parts of molded thermoplastic urethane that are bonded together;

said pads each comprising: at least one outer part comprising an outer sheet having the selected curvature of the rigid shell adjacent the portion of the inner surface to which the pad is removably attached; and at least one inner part comprising an inner sheet that is substantially parallel to and spaced inwardly from an outer sheet to define a space between the inner and outer sheets that is open around a perimeter of the inner and outer sheets; each of the inner and outer sheets have a plurality of spaced apart projecting hollow protrusions extend to the other sheet, the protrusions of one sheet alternating with the protrusions of the other sheet to form an impact absorbing pattern of alternating protrusions in the space between the sheets;

each protrusion having a open larger diameter base at the sheet from which it extends, a smaller diameter peak with a peak opening therein, and a side wall that tapers from the base to the peak; each base being one piece with the sheet from which it extends and each peak being fused to the sheet of the other part of the pad; the peak opening in each peak extending also through the sheet of the other part of the pad;

at least some of the sheets having additional vent openings between the open base of their protrusions and peak openings; and including at least one scalloped edge at the periphery of the space; and inside padding removably attached to an inside surface of the inner sheet.

2. A helmet arrangement as claimed in claim 1, wherein, in areas where higher impact resistance is desired, the alternating protrusions are more densely packed and are spaced more closely to each other, and the protrusions are less densely packed and are spaced further from each other in areas where lower impact resistance is desired.

3. A helmet arrangement as claimed in claim 1, wherein, the alternating protrusions are more densely packed and are spaced more closely to each other in the frontal and occipital pads for greater impact resistance, and the protrusions are less densely packed and spaced further from each other in the temporal and crown pads for resisting lower impact.

4. A helmet arrangement as claimed in claim 1, wherein said frontal and crown, temporal and occipital pads have a hardness of between about 60 Shore-A and 90 Shore-D.

5. A helmet arrangement as claimed in claim 1, wherein said plurality of inwardly projecting hollow protrusions are frustoconical in shape with circular open bases and flat circular peaks containing the peak openings.

6. A helmet arrangement as claimed in claim 1, wherein at least some of the protrusions of some of the pads with less impact resistance have curved side walls that taper from the base to the peak, and at least some of the protrusions of some of the pads with greater impact resistance have straight side walls that taper from the base to the peak.

7. A protective arrangement comprising:

a rigid shell adapted to cover a body part of a wearer, the rigid shell having an inner surface with selected concave curvatures; and at least one impact absorbing pad removably attached to the inner surface of said rigid shell, said pads comprising at least one outer part comprising an outer sheet having the selected curvature of the rigid shell and at least one inner part comprising an inner sheet that is substantially parallel to and spaced inwardly from the outer sheet to define a space between the inner and outer sheets that is open around a perimeter of the inner and outer sheets;

each of the inner and outer sheets have a plurality of spaced apart projecting hollow protrusions extending to the other sheet, the protrusions of one sheet alternating with the protrusions of the other sheet to form an impact absorbing pattern of alternating protrusions in the space between the sheets;

each protrusion having a open larger diameter circular base at the sheet from which it extends, a smaller diameter circular flat peak with a peak opening therein, and a frustoconical side wall that tapers from the base to the peak;

each base being one piece with the sheet from which it extends and each peak being fused to the sheet of the other part of the pad, the peak opening in each peak extending also through the sheet of the other part of the pad;

at least some of the sheets having additional vent openings between the open base of their protrusions and peak openings and including at least one scalloped edge at the periphery of the space.

8. An arrangement as claimed in claim 7, wherein, in areas where higher impact resistance is desired, the alternating protrusions are more densely packed and are spaced more closely to each other, and the protrusions are less densely packed and are spaced further from each other in areas where lower impact resistance is desired.

9. An arrangement as claimed in claim 7, wherein the inner and outer parts of the pad are molded entirely of thermoplastic urethane and the parts are welded together by fusing the flat peaks of the protrusions of one part to the sheet of the other part.

10. An arrangement as claimed in claim 7, wherein the pad is made from thermoplastic urethane having a hardness of between about 60 Shore-A and 90 Shore-D.

11. An arrangement as claimed in claim 7, wherein at least some of the protrusions with less impact resistance have curved side walls that taper from the base to the peak, and at least some of the protrusions with greater impact resistance have straight side walls that taper from the base to the peak.

12. An arrangement as claimed in claim 7, wherein at least some of the protrusions have curved side walls that taper from the base to the peak.

13. An arrangement as claimed in claim 7, wherein at least some of the protrusions have straight side walls that taper from the base to the peak.

14. An arrangement as claimed in claim 7, wherein said plurality of inwardly projecting hollow protrusions are arranged in pairs which extend in the same direction from the outer sheet and the inner sheet.

15. An arrangement as claimed in claim 7, including padding attached to an inner surface of the inner sheet.

* * * * *